US006004169A

United States Patent [19]

Wu

[11] Patent Number: 6,004,169

[45] Date of Patent: Dec. 21, 1999

[54] CONTACTS FOR HIGH DENSITY ELECTRIC CONNECTOR

[75] Inventor: Kun-Tsen Wu, Tu-Chen, Taiwan

[73] Assignee: Hon Hai Precision Ind. Co., Ltd., Taipei Hsien, Taiwan

[21] Appl. No.: 08/940,680

[22] Filed: Sep. 30, 1997

[30] Foreign Application Priority Data

Oct. 30, 1996 [TW] Taiwan ..... 85216813

[51] Int. Cl.[6] ..... H01R 11/22

[52] U.S. Cl. ..... 439/856; 439/567; 439/607

[58] Field of Search ..... 439/607–20, 567, 439/570–575, 75, 79, 92, 95, 856–7, 861, 943

[56] References Cited

U.S. PATENT DOCUMENTS 5,194,022 3/1993 Enomoto ..... 439/851

5,797,769 8/1998 Yang et al. ..... 439/571

5,865,645 2/1999 Embo et al. ..... 439/567

*Primary Examiner*—Lincoln Donovan

[57] ABSTRACT

Contacts for a high density electric connector are disclosed. The contacts include two types each having a body portion for engaging with a dielectric housing of the connector and a terminal portion for connecting with a printed circuit board, wherein the body portions each have an identical structure and the terminal portions are perpendicularly bent relative to the body portions in opposite directions. The second type contacts are mounted to the housing of the connector in an inverted manner with respect to the mounting manner of the first type contacts and the terminal portions of the contacts are equidistantly spaced from each other when the contacts are mounted to the housing of the connector. Each of the terminal portions extends from a rear side of a corresponding body portion from a point a distance away from a middle line defined by the corresponding body portion.

5 Claims, 8 Drawing Sheets

CONTACTS FOR HIGH DENSITY ELECTRIC CONNECTOR

BACKGROUND OF THE INVENTION

1. Field of the Invention

The present invention relates to contacts for an electric connector, particularly to contacts for a high density electric connector which has contacts arranged in several rows wherein the contacts lie in an alternating pattern between two neighboring rows.

2. The Prior Art

Contacts are one of the major components constituting an electric connector. Generally, each contact can be divided into a contact portion received in a contact passage formed in a dielectric housing for engaging with a mating contact of a mating connector and a terminal portion for connecting to a printed circuit board.

Conventionally, each contact has a configuration which is symmetrical around a middle line thereof. Such contacts are disclosed in Taiwan Patent Application Nos. 78212155, 80101193, 81205825, 81212441, 83210687, 83212080 and 83212081, and U.S. Pat. Nos. 4,175,821, 4,720,276, 4,720,277, 4,721,484, 5,151,056, and 5,252,079.

Following the trend of increasingly compact computer structure, electric connectors are adapted to accommodate more contacts in a smaller space. Such a connector is called a high density electric connector which has several rows of contacts lying in an alternating pattern between two neighboring rows. Such high density connectors are disclosed in Taiwan Patent Application Nos. 77207089, 79214090, 80209366, 80207178, 81212697, 82213344, 83216753, 84201969, 84208329 and 84211184. The prior art discloses two methods to alternately mount the contacts to the connector. Terminal portions of the contacts can be bent not only perpendicularly but also laterally relative to the contact portions thereof. Alternatively, different die assemblies can be used to stamp the contacts to have different configuration in neighboring rows.

The former of the above-mentioned two methods to form the contacts of a high density connector is laborious and time consuming since more than one bending operation step is required to form the terminal portion. The latter is costly since different die assemblies are required.

Hence, a need exists for contacts of a high density electric connector wherein the contacts are formed by stamping a metal sheet with a single die assembly and terminal portions of the contacts are formed by a single bending operation causing the terminal portions to be perpendicular to the contact portions of the contacts.

SUMMARY OF THE INVENTION

An objective of the present invention is to provide contacts for a high density connector wherein the contacts are formed by stamping a metal sheet with a single die assembly.

Another objective of the present invention is to provide contacts for a high density connector wherein the terminal portions of the contacts are formed by a single bending operation causing the terminal portions to be perpendicular to the contact portions of the contacts.

To fulfill the above-mentioned objectives, according to an aspect of the present invention, contacts for a high density electric connector include two types of contacts, namely, a first and second type. Both types of contacts are formed by stamping a metal sheet with a die assembly to obtain raw contacts each having a body portion and a raw terminal portion in alignment with the body portion. The raw terminal portions of some raw contacts are bent perpendicularly relative to the body portions thereof in a first direction to obtain the first type contacts. The raw terminal portions of the other raw contacts are bent perpendicularly relative to the body portions thereof in a second direction opposite to the first direction to obtain the second type contacts. The body portions of both the first and second type contacts are mounted to a dielectric housing of the connector and the terminal portions thereof connect with a printed circuit board. Each body portion includes a fitting portion for fitting with the housing of the connector to fix the contact to the housing and a contact portion for engaging with a mating contact of a mating connector. The body portions of both the first and second type contacts have an identical structure. The terminal portions of the first and second type contacts are bent relative to the body portions in opposite directions, respectively. When mounting the contacts to the housing of the connector, the second type contacts are mounted in an inverted manner relative to the orientation of the first type contacts. Each body portion defines a middle line and each terminal portion extends from the body portion a distance away from the middle line. When mounted to the housing of the connector, the terminal portions of the contacts are equidistantly spaced.

DETAILED DESCRIPTION OF THE PREFERRED EMBODIMENT

Throughout the specification, except when indicated otherwise, the side where the terminal portion (or raw terminal portion) is located is referred to as a rear side of the contact and where the contact portion is located is referred as to a front side thereof.

Figure 3:
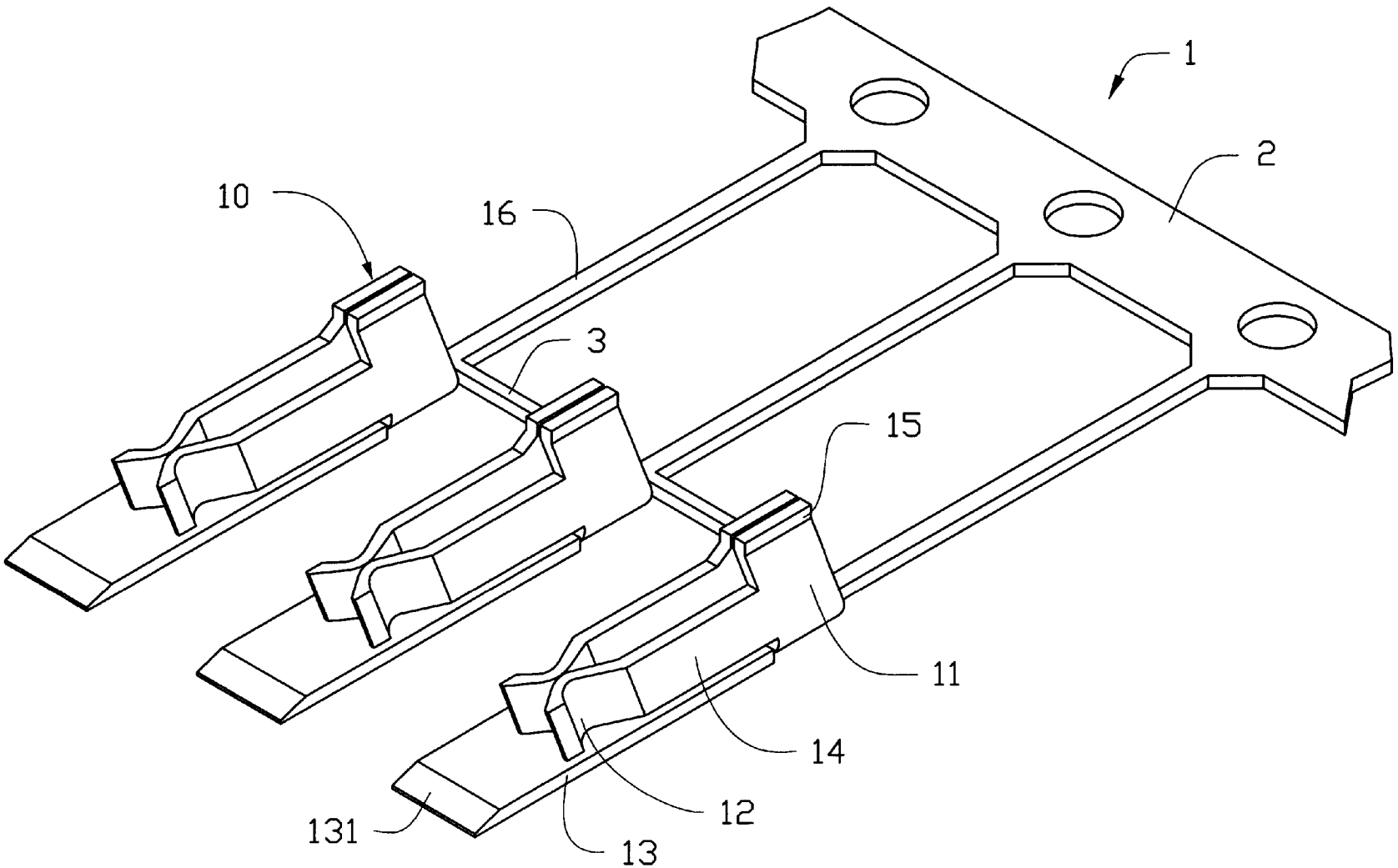
FIG. 3 is a perspective view showing three raw contacts formed by stamping a metal sheet with a die assembly, wherein the three raw contacts have three raw terminal portions in alignment with corresponding body portions and connected to a common blank.

Referring first to FIG. 3, three raw contacts 10 are formed by stamping a metal sheet 1 with a die assembly, wherein each raw contact 10 is formed with a body portion 11 connected to a common blank 2 via a raw terminal portion 16 in alignment with the body portion 11 and the other raw terminal portions 16 via a bridge 3 perpendicular to the raw terminal portion 16. Thereafter, as known by those skilled in the art, a cutting operation is applied to the raw contacts 10 to separate them from the common blank 2 and the connecting bridges 3. Each of the raw terminal portions 16 is then subject to a bending operation to be formed as a terminal portion for a corresponding contact.

The body portion 11 of each raw contact 10 has a triangular cross section with a separate top end. A first fitting portion 13 extends forward from a bottom of the body portion 11, two second fitting portions 15 extend upward from the top end of the body portion 11, and two contact portions 12 respectively extend forward from two sides of the triangular body portion 11 via two leaf portions 14. The leaf portions 14 provide the contact portions 12 with a certain degree of resilience so that when a mating contact (not shown) is inserted into the space between the contact portions 12, the contact portions 12 can tightly engage with the inserted contact (not shown). The first fitting portion 13 and the second fitting portions 15 are used to interferentially engage with a housing (not shown) of a connector (not shown) incorporating the contacts in accordance with the present invention to fixedly mount the contacts to the housing. The first fitting portion 13 forms a slant 131 at its front end for being matingly received in a first receiving recess 217 (FIG. 6) defined by a contact passage of the housing of the connector.

Figure 1:
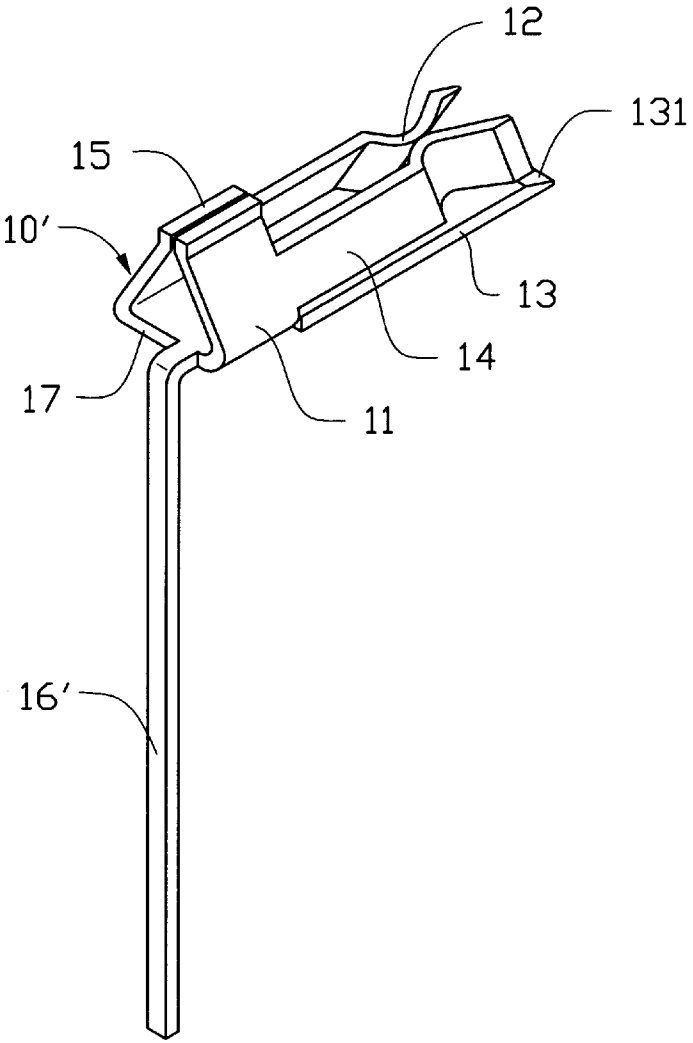
FIG. 1 is a perspective view showing a first type contact in accordance with the present invention, wherein the contact has a terminal portion bent downward from a body portion thereof.
Figure 4:
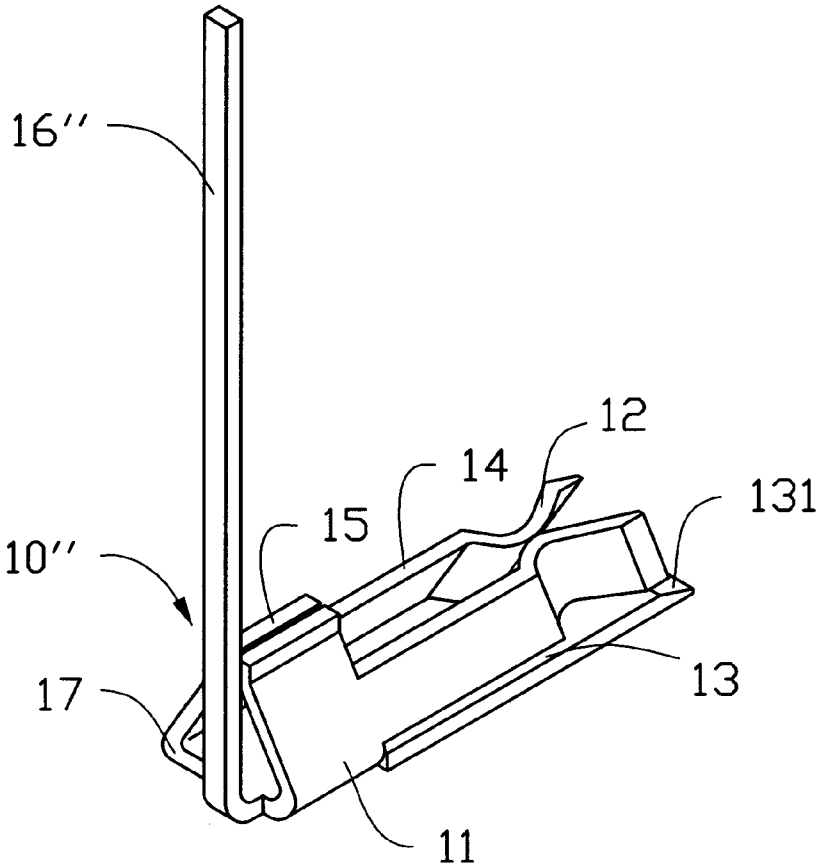
FIG. 4 is a perspective view showing a second type contact in accordance with the present invention, wherein the contact has a terminal portion bent upward from a body portion thereof.

Now also referring to FIGS. 1 and 4, the raw terminal portion 16 extends rearward from a point on a rear edge 17 of the bottom of the triangular body portion 11 a distance from a middle line (not shown) of the body portion 11. Terminal portions are obtained by bending the raw terminal portion extending from a right side of the rear edge 17 of the bottom of the triangular body portion 11.

Figure 2:
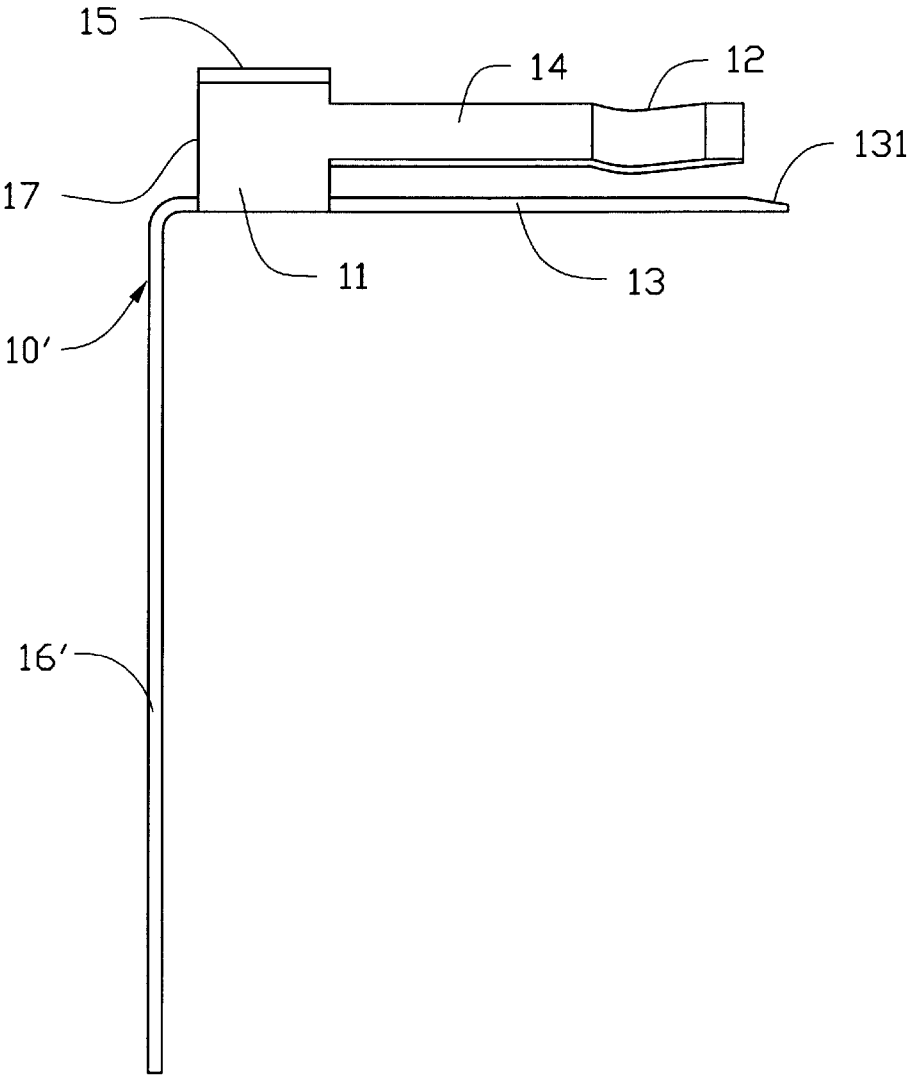
FIG. 2 is a side view of FIG. 1.

Now also referring to FIG. 2, the contacts of the present invention can be categorized into two types: the first type, as shown in FIGS. 1 and 2 and indicated by reference number 10', is obtained by bending the raw terminal portion 16 of the raw contact 10 perpendicularly downward relative to its body portion 11 (i.e. in a direction away from the body portion 11) to get a terminal portion 16'. The second type, as shown in FIG. 4 and indicated by reference number 10", is obtained by bending the raw terminal portion 16 of the raw contact 10 perpendicularly upward relative to its body portion 11 (i.e., in a direction toward the body portion 11) to get a terminal portion 16".

Figure 5:
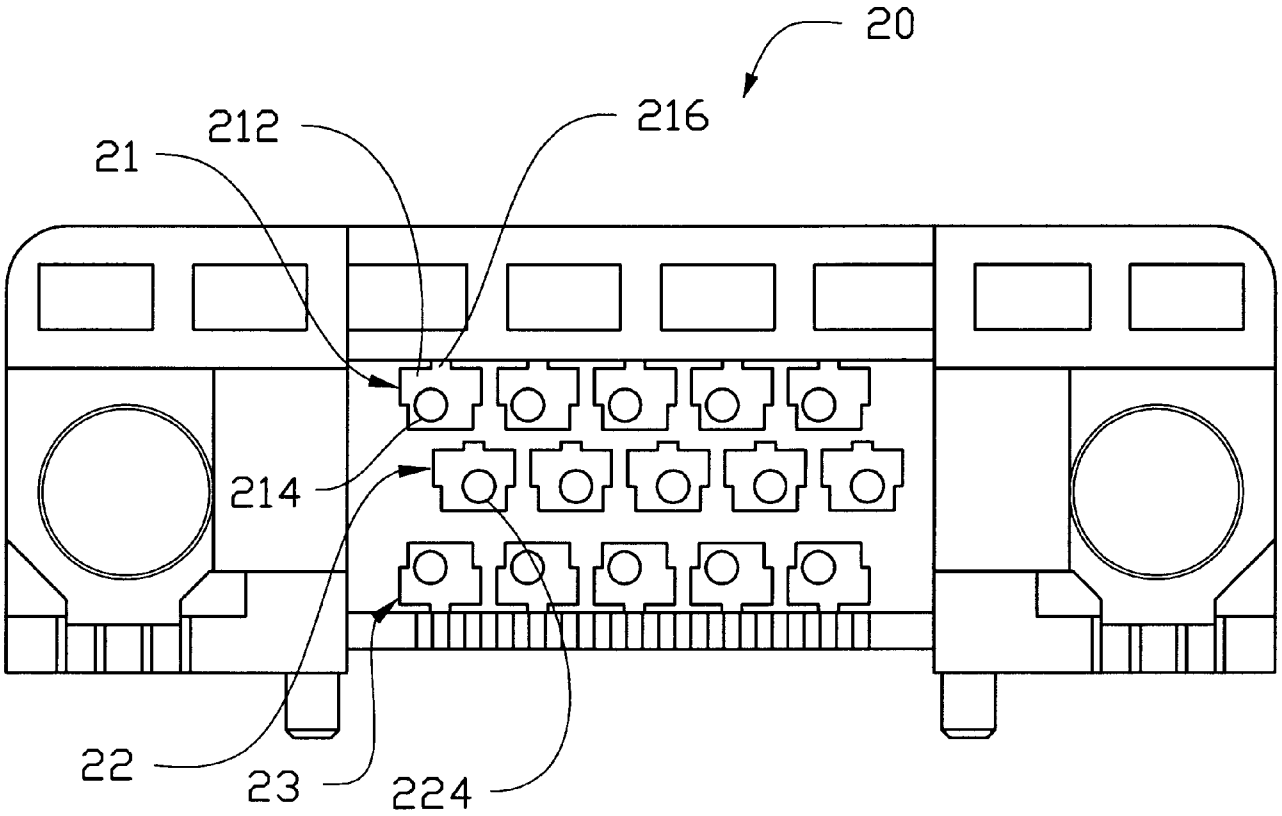
FIG. 5 is a rear view showing a rear side of a housing of a connector for accommodating the contacts in accordance with the present invention.
Figure 6:
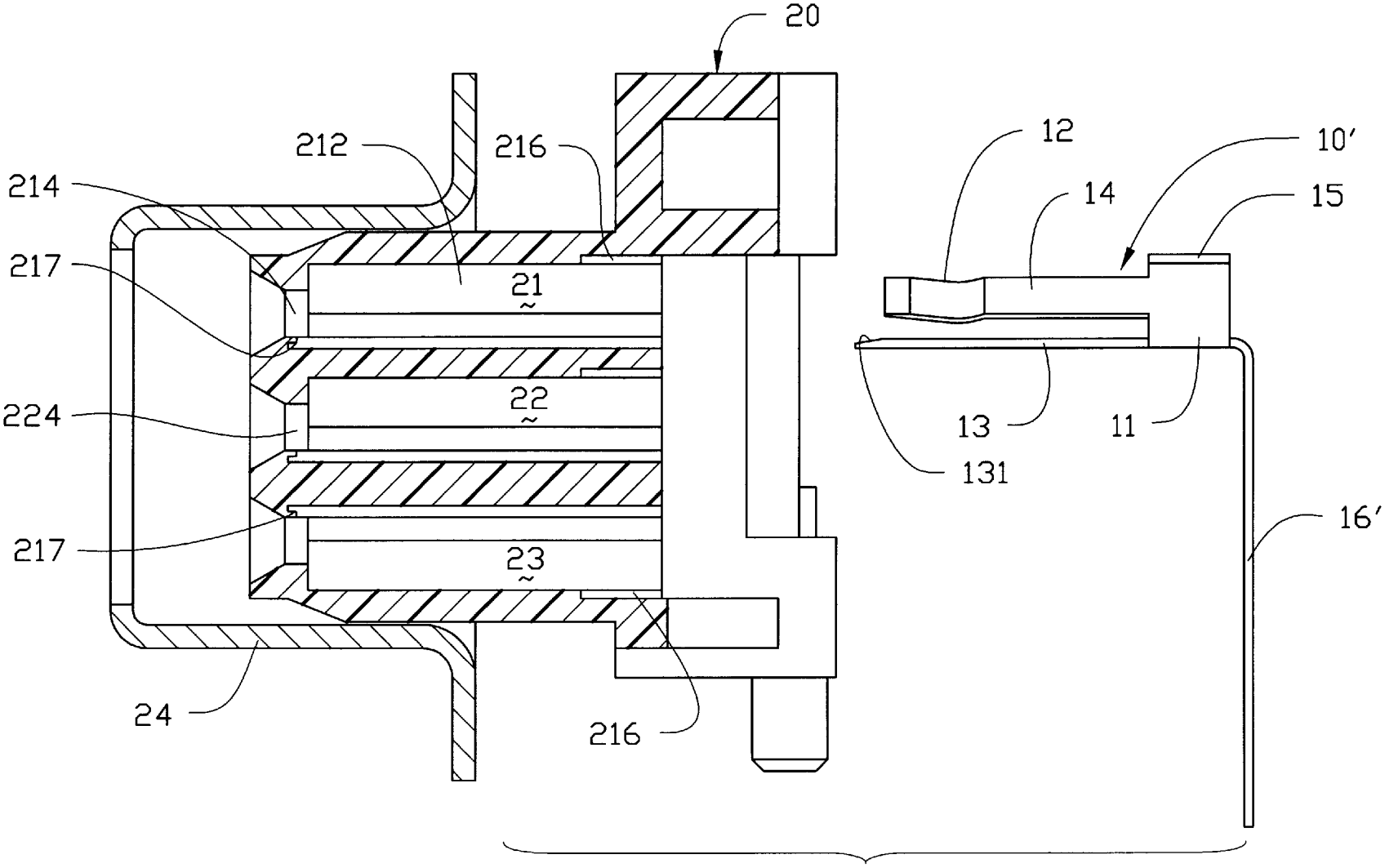
FIG. 6 is a side, cross-sectional view showing the assembly of a metal shielding, a dielectric housing and the contact of FIGS. 1 and 2.

FIG. 5 shows a rear side of a housing 20 of a high density electric connector for receiving the contacts 10', 10" in accordance with the present invention. The housing 20 includes five contact passages each arranged in three horizontal rows (upper passages 21, middle passages 22 and lower passages 23) for receiving the contacts 10' and 10". Each upper passage 21 defines a T-shaped slot 212 for receiving a corresponding contact 10' and a hole 214 defined near a lower left corner of the T-shaped slot 212 for insertion of a contact portion of a mating contact (not shown). Referring also to FIG. 6, a second receiving recess 216 is defined at a top of the slot 212 for receiving the second fitting portions 15 of the contact 10'. The first receiving recess 217 is defined at a front end of a bottom of the T-shaped slot 212 for receiving the slanted front end 131 of the first fitting portion 13 of the contact 10'.

The middle contact passages 22 are alternately located relative to the upper contact passages 21. Each of the middle contact passages 22 has a configuration similar to that of each of the upper contact passages 21; however, a hole 224 is defined near a lower right corner thereof. The lower contact passages 23 are aligned with the upper contact passages 21 and each is configured as a mirror image of a corresponding one of the upper contact passages 21 about a middle line (not shown) between the upper and lower contact passages 21, 23.

Figure 7:
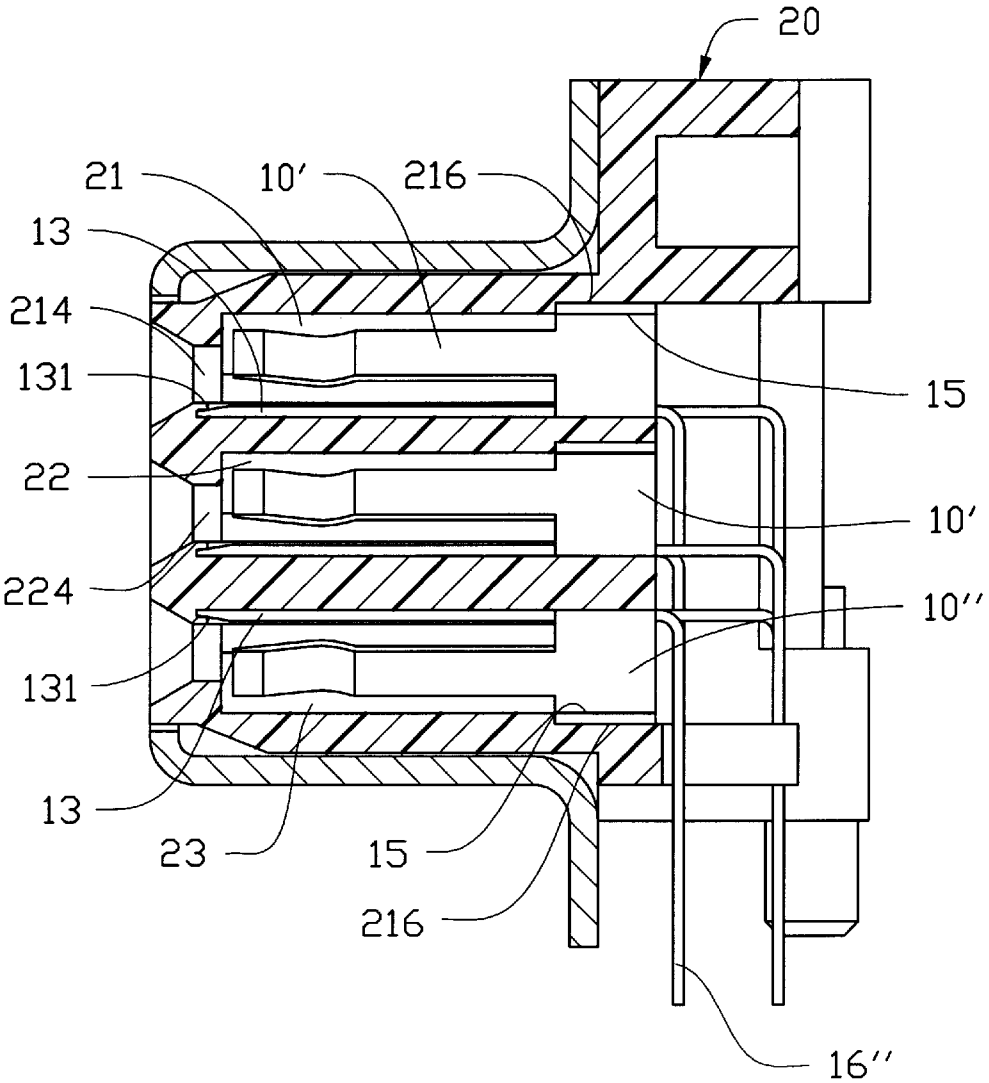
FIG. 7 is a view similar to FIG. 6, but shows the assembly of the shielding, the housing and the contact of FIG. 6 and other contacts in accordance with the present invention.

To assemble the connector, as shown in FIGS. 6 and 7, a metallic shielding 24 is fitted to the housing 20 of the connector from a front side thereof. A first contact 10' is inserted into a corresponding upper contact passage 21 from a rear side of the housing 20 to reach a position in which the first fitting portion 13 is interferentially engaged with the housing 20, the front end of the first fitting portion 13, which forms the slant 131, is received in the first receiving recess 217, and the second fitting portions 15 are interferentially fitted in the second receiving recess 216, whereby the contact 10' is fixedly mounted to the housing 20. Similarly, four other contacts 10' each having a structure identical to that of the first contact 10' are each successively mounted into the other four upper contact passages 21.

Thereafter, five contacts 10' each having a structure similar to that of the contacts 10' inserted into the upper contact passages 21, but having a shorter terminal portion, are mounted into the middle contact passages 22 in a manner similar to that for mounting the previous five contacts 10' to the upper contact passages.

Figure 8:
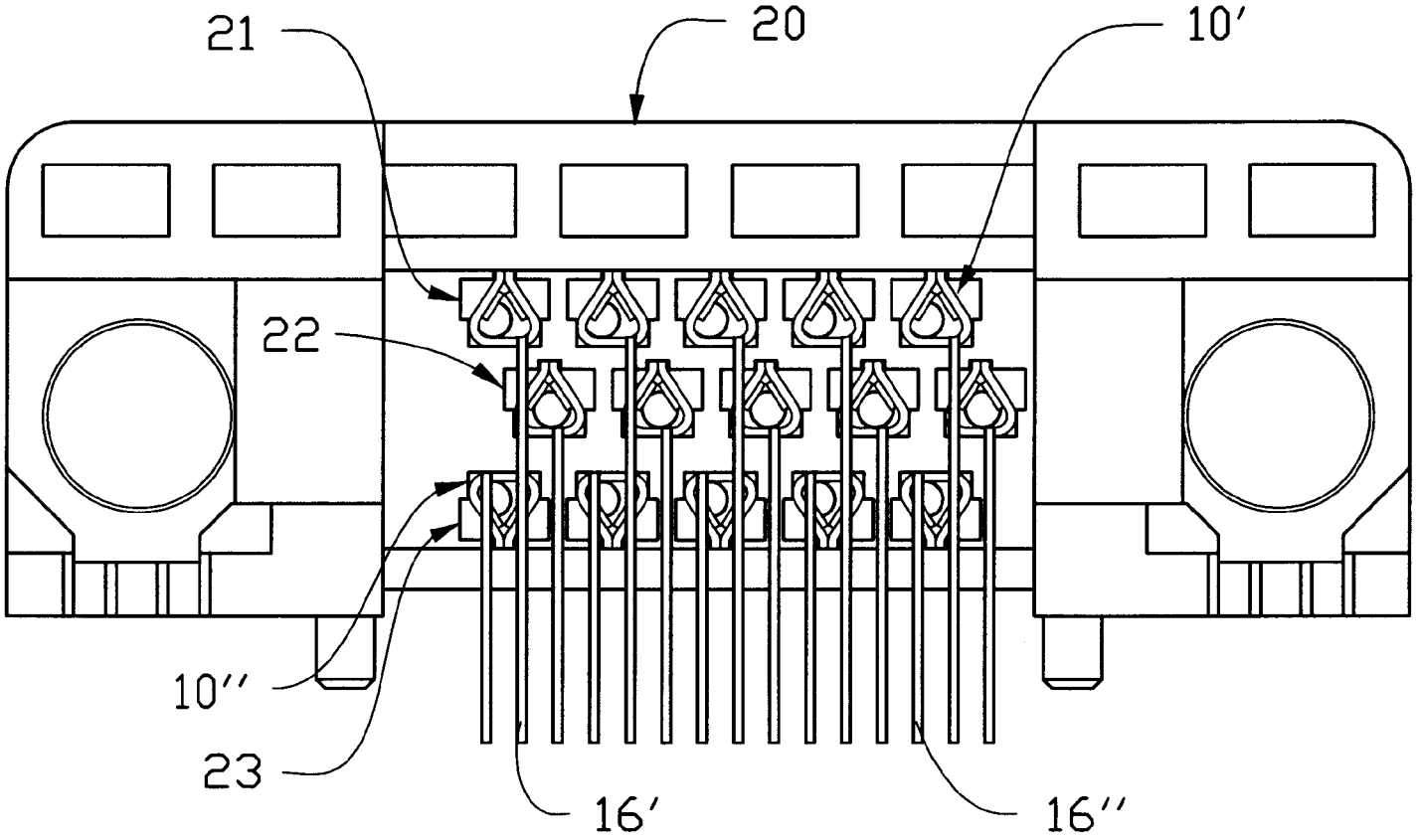
FIG. 8 is a rear view of the connector of FIG. 7.

Finally, five contacts 10" are mounted into the lower contact passages 23, in which each of the contacts 10" is firstly inverted from the position as shown in FIG. 4 so that its terminal portion 16" extends downward and its first mounting portion 13 is located above the body portion 11. The contacts 10" are then inserted into the lower contact passages 23 to reach a position in which the first fitting portion 13 thereof is interferentially engaged with the housing 20, the front end of the first fitting portion 13, which forms a slant 131, is received in the first receiving recess 217 defined in a front end of the top of the lower contact passage 23, and the second fitting portions 15 are interferentially fitted into the second receiving recess 216 located at a bottom of the lower contact passage 23. Thus, as shown in FIG. 8, the contact terminal portions 16', 16" of the contacts 10', 10" mounted to the housing of the connector equidistantly extend downward from the rear side of the housing 20 to obtain a high density electric connector.

As disclosed above and referring back to FIG. 3, the contacts 10', 10" are formed from the raw contacts 10, which are made by stamping a metal sheet with a single die assembly thereby reducing the cost of the die assembly. Furthermore, the contacts 10', 10" are obtained by vertically bending the raw terminal portions 16 relative to the body portions 11 only once, without any lateral bending, so that the forming of the contacts 10', 10" can be easily and quickly achieved.

While the present invention has been described with reference to a specific embodiment, the description is illustrative of the invention and is not to be construed as limiting the invention in any way. Various modifications to the present invention can be made to the preferred embodiment by those skilled in the art without departing from the true spirit and scope of the invention as defined by the appended claims.

It is claimed that:

1. A high density electric connector, comprising:

a dielectric housing defining a front face for receiving a mating connector, a rear face opposite to the front face, a bottom wall for attachment to a printed circuit board, a top wall opposite to the bottom wall, a first lateral side and a second lateral side opposite to the first lateral side, said dielectric housing comprising an upper row of upper contact passages, a middle row of middle contact passages and a lower row of lower contact passages in alignment with the upper ones, the middle row being offset from the upper and lower rows;

a plurality of first contacts mounted to the upper contact passages, each first contact having a first elongated body portion and a first straight terminal portion extending from the first elongated body portion about a lateral side of a rear edge of the first body portion closer to the first lateral side of the housing, the first elongated body portion being fitted into the upper contact passage, the first terminal portion extending perpendicularly from the first body portion downward to the bottom wall of the housing;

a plurality of second contacts mounted to the middle contact passages, each second contact having a structure similar to that of the first contact and having a second elongated body portion being fitted into the middle contact passage and a second terminal portion extending perpendicularly from the second body portion downward to the bottom wall of the housing; and a plurality of third contacts mounted to the lower contact passages, each third contact having a third elongated body portion having a structure similar to that of the first body portion and having a straight third terminal portion extending from the third body portion about a lateral side of a rear edge of the third body portion closer to the second lateral side of the housing, the third body portion being fitted to the lower contact passage, and the third terminal portion extending perpendicularly from the third body portion downward to the bottom wall of the housing;

wherein the first, second and third terminal portions are equidistantly spaced from each other as viewed from the rear face of the housing.

2. The connector in accordance with claim 1, wherein a metal shielding is mounted to a front portion of the housing.

3. The connector in accordance with claim 1, wherein each upper contact passage is formed to have a T-shaped slot and a first round hole located at a bottom corner of the T-shape slot near the first lateral side of the housing, each middle contact passage has a configuration similar to the same as that of the upper contact passage but has a second round hole located at a bottom corner of the T-shaped slot near the second lateral side of the housing, and each lower contact passage has a configuration being a mirror image of that of the upper contact passage about a middle line between the upper and lower contact passages, said T-shaped slots receiving the body portions of the contacts, said round holes being used for an insertion of contact portions of contacts of a mating connector into the contact passages.

4. The connector in accordance with claim 3, wherein each first body portion of the first contacts has a triangular cross section having a bottom plate and two side walls confronting each other at a top point thereof, two contact portions being extended from the two side walls of the first body portion toward the front face of the housing for engaging with a mating contact therebetween, the first terminal portion of the first contact extending downward from the bottom plate.

5. The connector in accordance with claim 3, wherein each third body portion of the third contacts has an inverted triangular cross section having a top plate and two side walls confronting each other at a bottom point thereof, two contact portions extending from the two side walls of the third body portion toward the front face of the housing for engaging with a mating contact therebetween, the third terminal portion of the third contact extending downward from the top plate.

* * * * *